US006702382B1

(12) United States Patent
Hoover et al.

(10) Patent No.: US 6,702,382 B1
(45) Date of Patent: Mar. 9, 2004

(54) ROCKER RECLINER LIFT SYSTEM

(76) Inventors: Michael Hoover, 8138 Seaton Pl., Montgomery, AL (US) 36116; Steven Engle, 485 Wedgefield Dr. West, Mobile, AL (US) 36608

( * ) Notice: Subject to any disclaimer, the term of this patent is extended or adjusted under 35 U.S.C. 154(b) by 0 days.

(21) Appl. No.: 10/094,725

(22) Filed: Mar. 11, 2002

(51) Int. Cl.[7] ..... A47C 3/02

(52) U.S. Cl. ..... 297/270.1; 297/DIG. 7; 297/270.3

(58) Field of Search ..... 297/270.1, 270.3, 297/270.5; 248/188.2; 254/94, 104

(56) References Cited

U.S. PATENT DOCUMENTS

| | | | | | |
|---|---|---|---|---|---|
| 1,912,038 | A | * | 5/1933 | Irish | 188/32 |
| 1,947,346 | A | * | 2/1934 | Lintern | 254/94 |
| 2,877,875 | A | * | 3/1959 | Bolt | 52/713 |
| 2,933,850 | A | * | 4/1960 | Martin | 248/188.2 |
| 3,232,253 | A | * | 2/1966 | Winters | 297/344.12 |
| 3,684,233 | A | * | 8/1972 | Vukich | 248/352 |
| 4,034,961 | A | * | 7/1977 | Breen | 254/94 |
| 4,218,093 | A | * | 8/1980 | Gertz | 297/423.43 |
| 4,917,219 | A | * | 4/1990 | Henry | 188/32 |
| 5,205,097 | A | * | 4/1993 | Harvey | 248/188.2 |
| 5,337,985 | A | * | 8/1994 | Hale | 248/174 |
| 6,152,529 | A | * | 11/2000 | Beason | 297/260.2 |
| 6,290,294 | B1 | * | 9/2001 | Volz | 297/270.5 |

* cited by examiner

*Primary Examiner*—Peter M. Cuomo
*Assistant Examiner*—Stephen D'Adamo
(74) *Attorney, Agent, or Firm*—Michael I. Kroll

(57) ABSTRACT

The present invention 10 discloses a lift system 12 for a rocker recliner comprising a rocker limiter 28 and a plurality of chair base lifts 40 which can be retrofitted to existing rocker recliners. The rocker limiter 28 is a device having an arcuate face 29 whereby the device can be fixedly positioned to the rocker cam 30 or rocker base 22 limiting the movement of the rocker mechanism in one direction. The chair base lifts 40 are a plurality of interlocking blocks or a single block that are engagingly positioned beneath the chair support base 26 to raise the rocker recliner by a distance determined by the number and thickness of chair height lifts positioned thereunder.

10 Claims, 15 Drawing Sheets

ROCKER RECLINER LIFT SYSTEM

BACKGROUND OF THE INVENTION

1. Field of the Invention

The present invention relates generally to chairs and more specifically to a rocker recliner lift system comprising a rocker recliner rocker limiter and a plurality of chair height adjusters attachments for rocker recliners that can be retrofitted to existing rocker recliners.

The rocker limiter is a device having a triangle-like structure having divergent curvilinear adjacent sides whereby said device can be fixedly positioned to the rocker cam or rocker base limiting the movement in one direction of the rocker mechanism.

Typically a rocker mechanism is comprised of rocker cams having a curved lower surface that engages the chair base having a spring assembly connected therebetween. When pressure is placed on the anterior or posterior portion of the seat the basically horizontal planar positioning of the seat is angularly displaced according to the force applied and the limits of the spring assembly. For the elderly and infirm this can present a problem because the angular displacement can position the patient in biomedical disadvantage such as their knee joints above their hip joints requiring a greater degree of effort to achieve a standing position. The reverse is also true in moving to a seated position in that a greater degree of control is required because the seat moves from a horizontal position to an angularly displaced position. It is a primary object of the present invention to fix the maximum degree of anterior angular displacement of the rocker recliner according to a user selectable position by situating the rocker limiter by means of suitable fastener to the rocker cam or rocker base.

It should also be noted that by using a fastening element such as hook and loop material the rocker limiter is easily relocatable. Therefore, the rocker recliner could be used as an exercise device by user's selectively repositioning the rocker limiter to increase the angular displacement of the seat.

The chair height adjusters are a plurality of interlocking blocks that are engagingly positioned beneath the chair base to raise the rocker recliner by a distance determined by the number and thickness of chair height adjusters positioned thereunder.

When used in combination with the rocker limiter the actual chair height can be raised between 2 inch to 3 inches while the effective chair height is raised 5 to 8 inches depending on the degree of rotation of the rocker cam.

The importance of this distinction between actual and effective chair height lies in the fact of not raising a chairs actual height by 5–8 inches which would be detrimental to the chair owner's comfort and safety. It also provides the benefit of keeping the chairs center of gravity lower than if the chair was actually raised 5–8 inches.

2. Description of the Prior Art

There are other devices designed for rocker recliners that limit the rocker movement. Most of these devices are manufactured as original equipment with the rocker recliner.

Therefore, it is felt that a need exist for a rocker recliner lift system that can be retrofitted to an existing rocker recliner whereby a user can selectively limit the rocker mechanism in one direction by use of a rocker limiter. The rocker limiter provides users with the means to modify their existing chairs on a selective basis whether it's for visiting friends or for a recuperation period due to illness or surgery.

Furthermore, it is felt that a need exist for a plurality of height adjusters, also being a component of the rocker recliner lift system, of varying thicknesses that can be placed in an engaging position beneath the base of the chair which provides the user with the ability to raise the chair by a user selectable height which can further increase the effectiveness of raising the seat to a position whereby an individual gains a biomedical advantage while sitting on or standing from said chair.

SUMMARY OF THE PRESENT INVENTION

The present invention discloses a rocker recliner lift system comprising a rocker limiter and a plurality of chair base lifts which can be retrofitted to existing rocker recliners. The rocker limiter is a device having an arcuate face whereby the device can be fixedly positioned to the rocker cam or rocker base limiting the movement of the rocker mechanism in one direction. The chair base lifts are a plurality of interlocking blocks or a single block that are engagingly positioned beneath the chair support base to raise the rocker recliner by a distance determined by the number and thickness of chair height lifts positioned thereunder.

The present invention is a rocker recliner lift system comprising a rocker recliner rocker limiter and a plurality of chair height adjusters attachments for rocker recliners that can be retrofitted to existing rocker recliners.

The rocker limiter is a device having a triangle-like structure having divergent curvilinear adjacent sides whereby said device can be fixedly positioned to the rocker cam or rocker base limiting the movement in one direction of the rocker mechanism.

The chair height adjusters are a plurality of interlocking blocks or a single block that are engagingly positioned beneath the chair base to raise the rocker recliner by a distance determined by the number and thickness of chair height adjusters positioned thereunder.

A primary object of the present invention is to provide a rocker recliner system for modifying the height of the chair and angular movement of the seating area.

Another object of the present invention is to provide a rocker recliner system having a rocker limiter whereby the angular movement of the chair can be selectively adjusted.

Yet another object of the present invention is to provide a rocker recliner system having height adjusters whereby the height of the chair can be selective raised and/or lowered.

Still yet another object of the present invention is to provide a rocker recliner system having a rocker limiter and chair height adjusters that work in conjunction whereby the angular movement of the chair and height of the chair can be independently and selective set by a user.

A further object of the present invention is to provide a rocker recliner lift system that will increase the effective seat and arm height while increasing the actual seat height to a substantially lesser degree.

A yet further object of the present invention is to provide a rocker recliner lift system that can be retrofitted to existing rocker recliners.

A still yet further object of the present invention is to provide a rocker recliner lift system that can be retrofitted to existing rocker recliners obviating the need for expensive lift chairs.

Another object of the present invention is to provide a rocker recliner lift system that can be retrofitted to existing rocker recliners in various user selectable positions whereby said chair can be used in an exercise program.

Yet another object of the present invention is to provide a rocker recliner lift system that can be retrofitted to existing rocker recliners in a permanent fashion to aid the elderly and infirm to continue to use their present rocker recliner.

Still yet another object of the present invention is that the chair base lifts increase a chairs base of support.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Various other objects, features and attendant advantages of the present invention will become more fully appreciated as the same becomes better understood when considered in conjunction with the accompanying drawings, in which like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
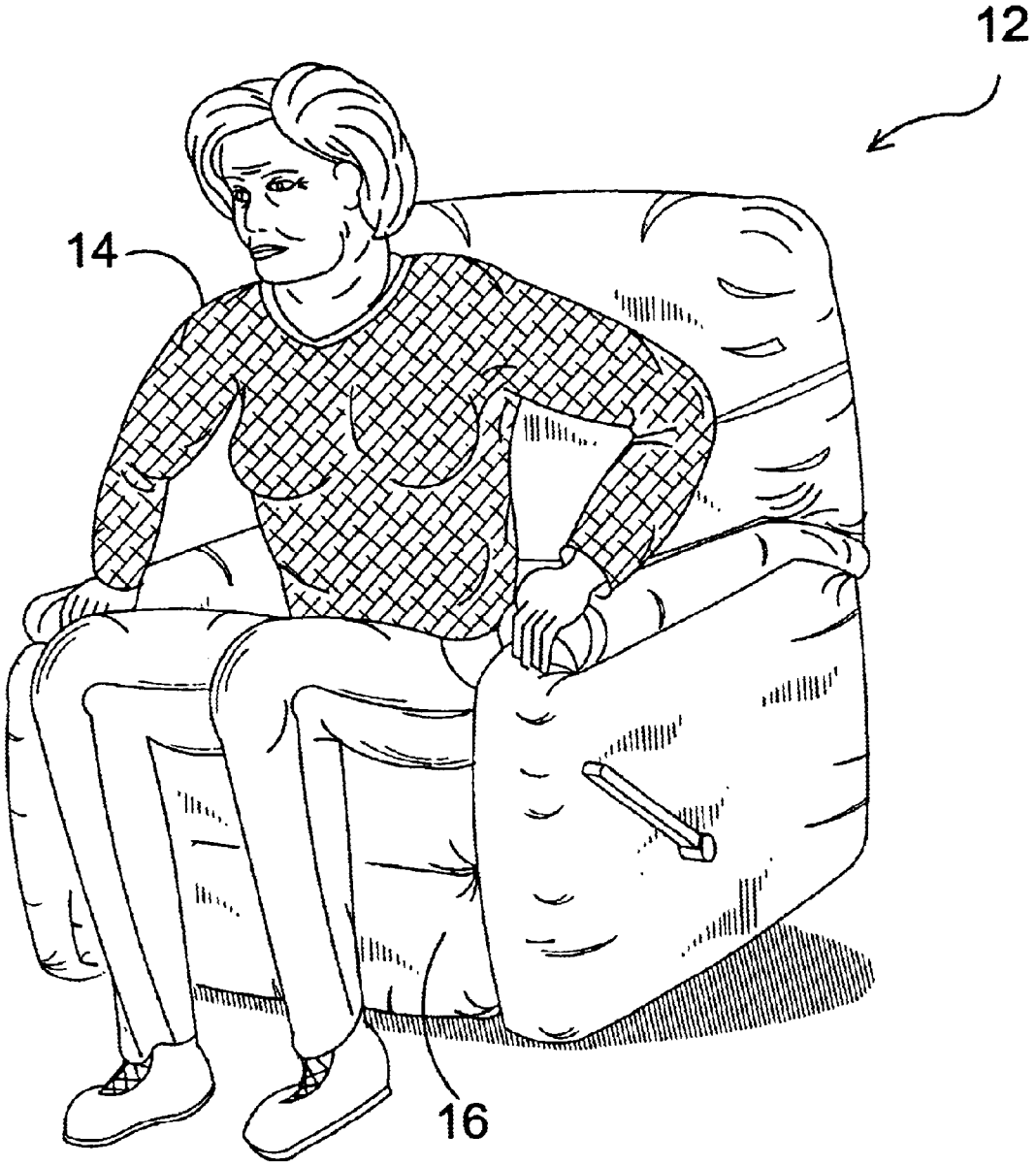
( PRIOR ART ) FIG. 1
FIG. 1 is an illustrative view of the prior art.

With regard to reference numerals used, the following numbering is used throughout the drawings.

10 present invention
12 rocker recliner
14 user
16 forward portion
18 spring assembly
20 rocker cam
22 rocker base member
24 seating area
26 support base
28 rocker limiter
29 rocker limiter face
30 rocker cam
31 side
32 force
34 effective chair height
36 hook and loop material
28 screws
40 base lift
42 tab
44 bore
46 screw holes
48 inset

DETAILED DESCRIPTION OF THE PREFERRED EMBODIMENT

The following discussion describes in detail one embodiment of the. This discussion should not be construed, however, as limiting the invention to those particular embodiments since practitioners skilled in the art will recognize numerous other embodiments as well. For a definition of the complete scope of the invention the reader is directed to the appended claims.

Turning to FIG. 1, shown therein is an illustrative view of a rocker recliner 12 which does not have the present invention installed thereon. This is representative of the prior art. Shown is a conventional rocker recliner 12 whereby when the user 14 of a the rocker recliner chair 12 proceeds to stand up the forward most portion of the chair 16 lowers in height in relation to the floor or support surface causing the user's knees to be in a higher position than the hips. This position causes the effective chair height to be decreased posing strain to a user having hip or knee problems, typically surgery patients and the elderly and the debilitated.

Figure 2:
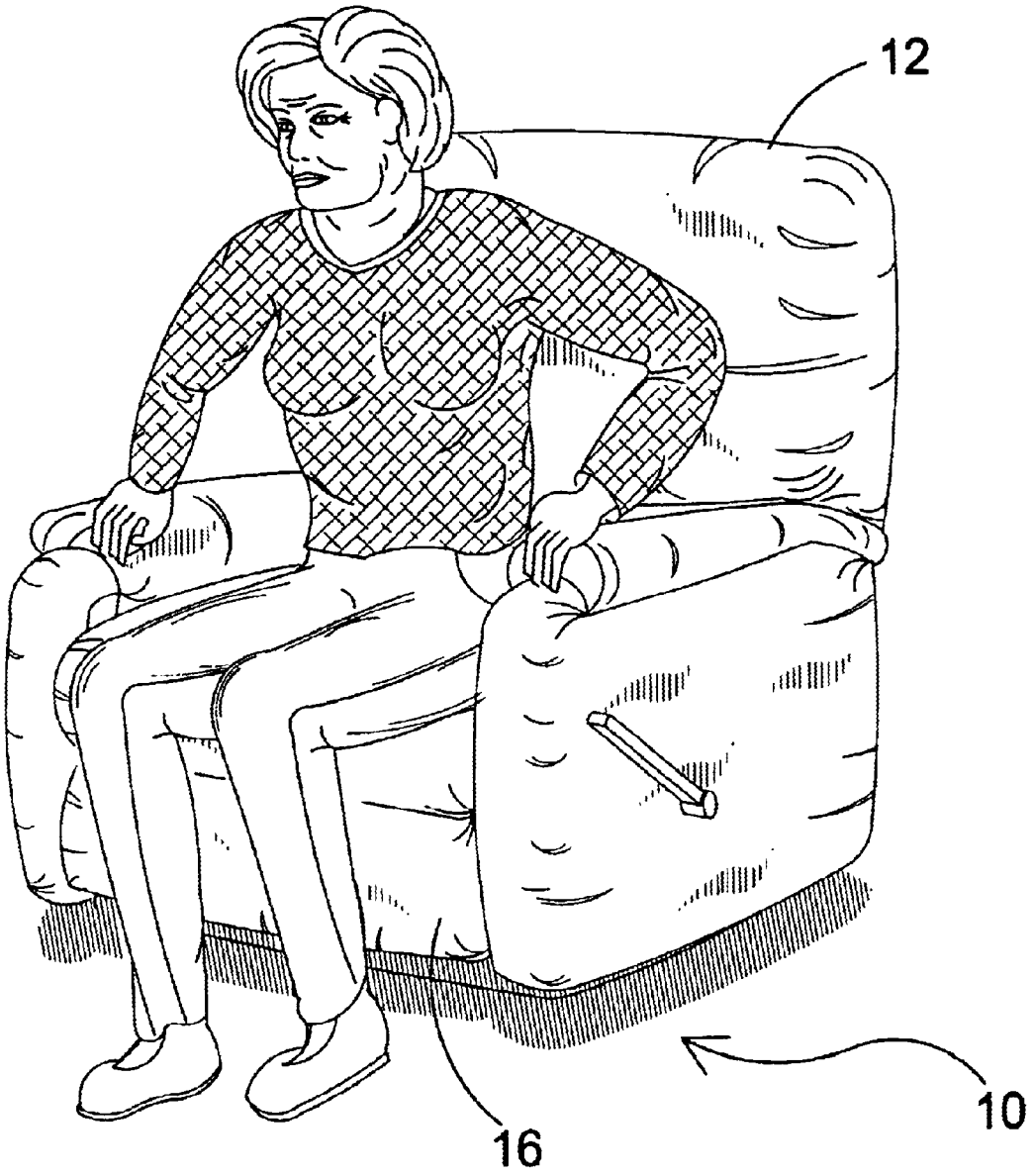
FIG. 2 is an illustrative view of the present invention in use.

Turning to FIG. 2, shown therein is an illustrative view of a rocker recliner 12 having the present invention 10 in use thereon. When the present invention's rocker limiter is installed on a rocker recliner 12, a reduction in the height of the forward most portion 16 of the rocker recliner is prevented, causing the user's knees to be in a lower elevation than the hip thereby increasing the effective chair height providing for a less stressful exit from the rocker recliner for the individual.

Figure 3:
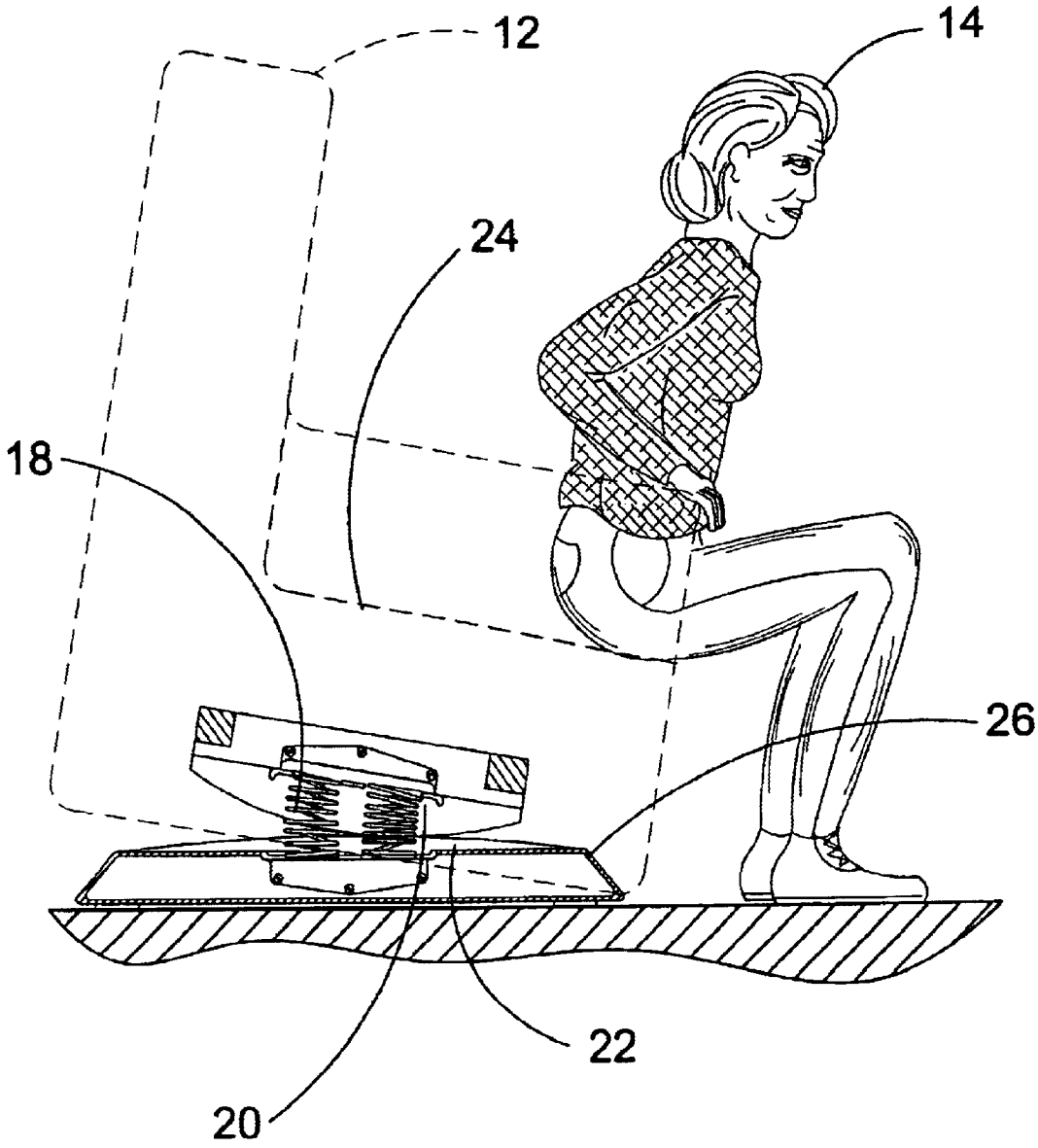
( PRIOR ART ) FIG. 3
FIG. 3 is a side view of the prior art.

Turning to FIG. 3, shown therein is a side view of the prior art rocker recliner 12. Depicted is the prior art rocker recliner 12 having a support base 26, a spring assembly 18, rocker cam 20 and rocker base 22 providing a mechanism that allows for angular displacement of the seating area 24 as previously explained. This presents a problem for the elderly or infirm because the angular displacement which this assembly produces can cause the user's hips to be in a lower position than the knees causing stress in the user's joints when exiting the chair because of a reduced effective chair height.

Figure 4:
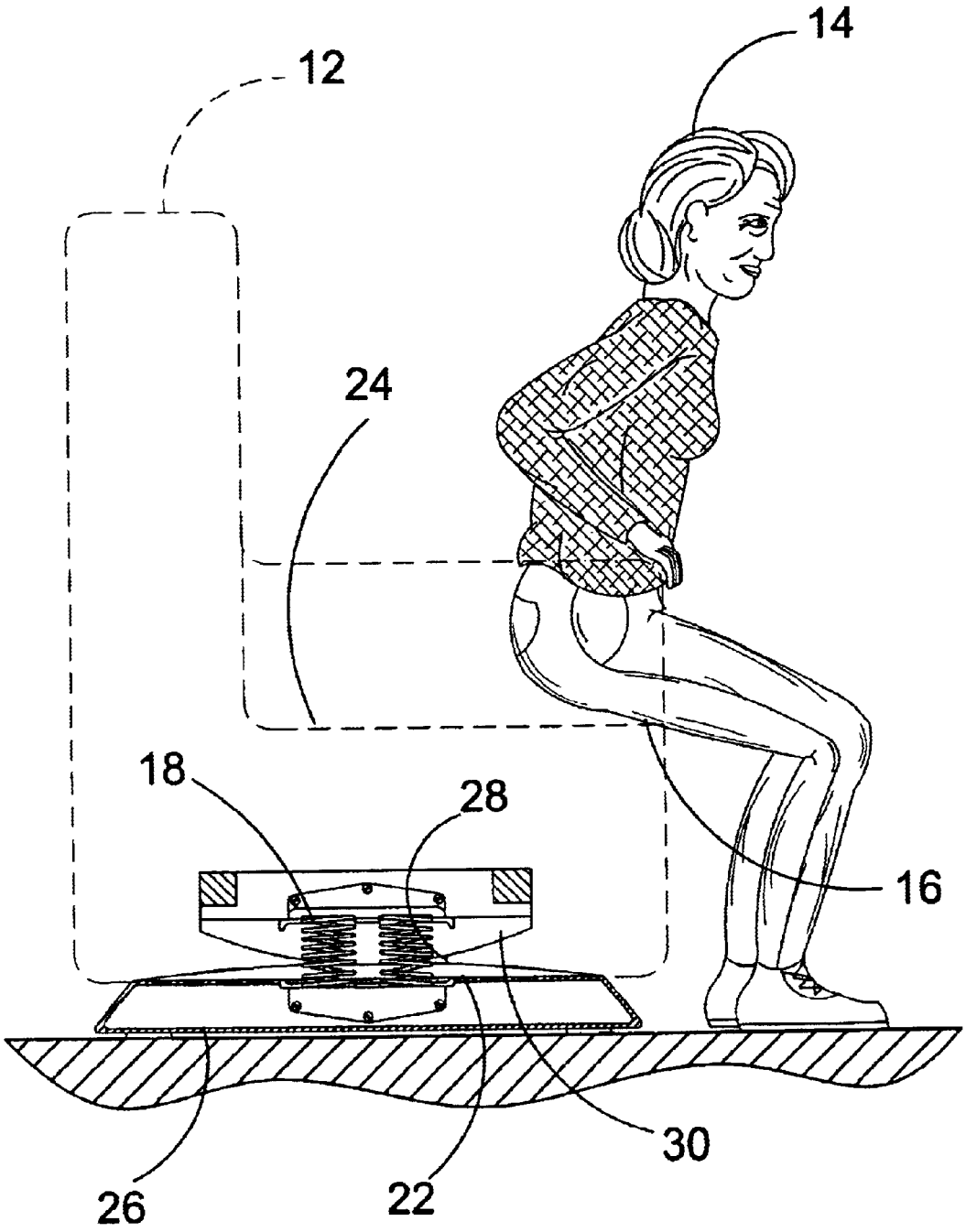
FIG. 4 is a side view of the rocker limiter installed on a rocker recliner.

Turning to FIG. 4, shown therein is a side view of the rocker limiter 28 of the present invention installed on a rocker recliner 12. Shown is a standard rocker recliner's internal components with the present invention's rocker limiter 28 installed on the rocker cam 30 to prevent forward angular displacement of the chair by preventing forward angular displacement caused by a force applied to the front most portion 16 of the rocker recliner's seating area 24, thereby providing a more preferable effective chair height where the user's hip is above the knees. Other elements previously disclosed are also shown.

Figure 5:
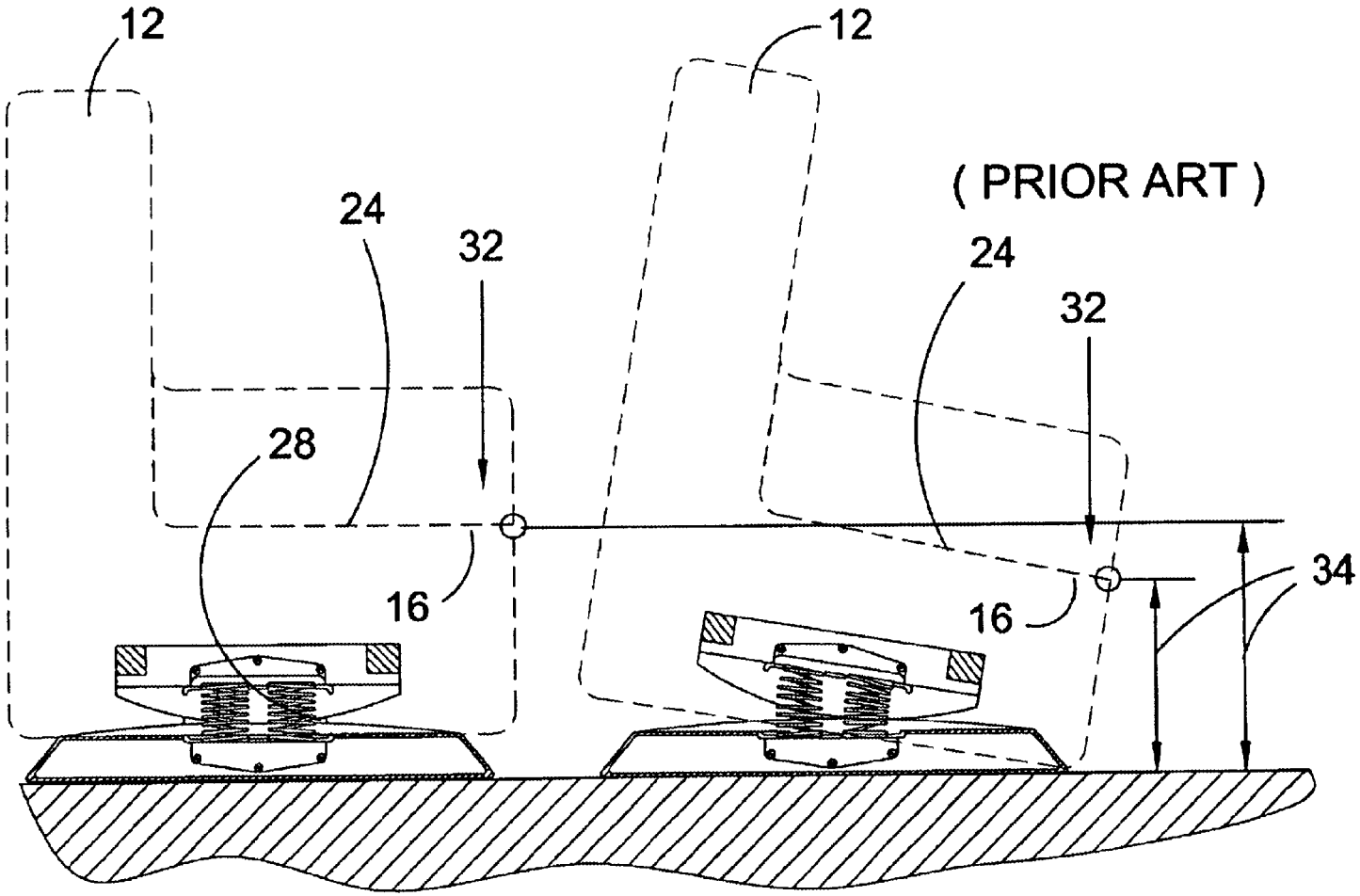
FIG. 5 is a comparison of effective chair heights.

Turning to FIG. 5, shown therein is a comparison of effective chair heights of a rocker recliner 12 with the rocker limiter 28 installed and the prior art without the rocker limiter installed. Shown are the effective chair heights of two rocker recliners 12 when a force 32 shown by a direction arrow is applied to the forward edge 16 of the seating area 24. The chair without the rocker limit has an angular displacement that reduces the effective chair height 34 of the rocker recliner. By installation of the rocker limiter 28, angular displacement of the rocker recliner 12 is prevented or reduced allowing for an increased effective chair height 34.

Figure 6:
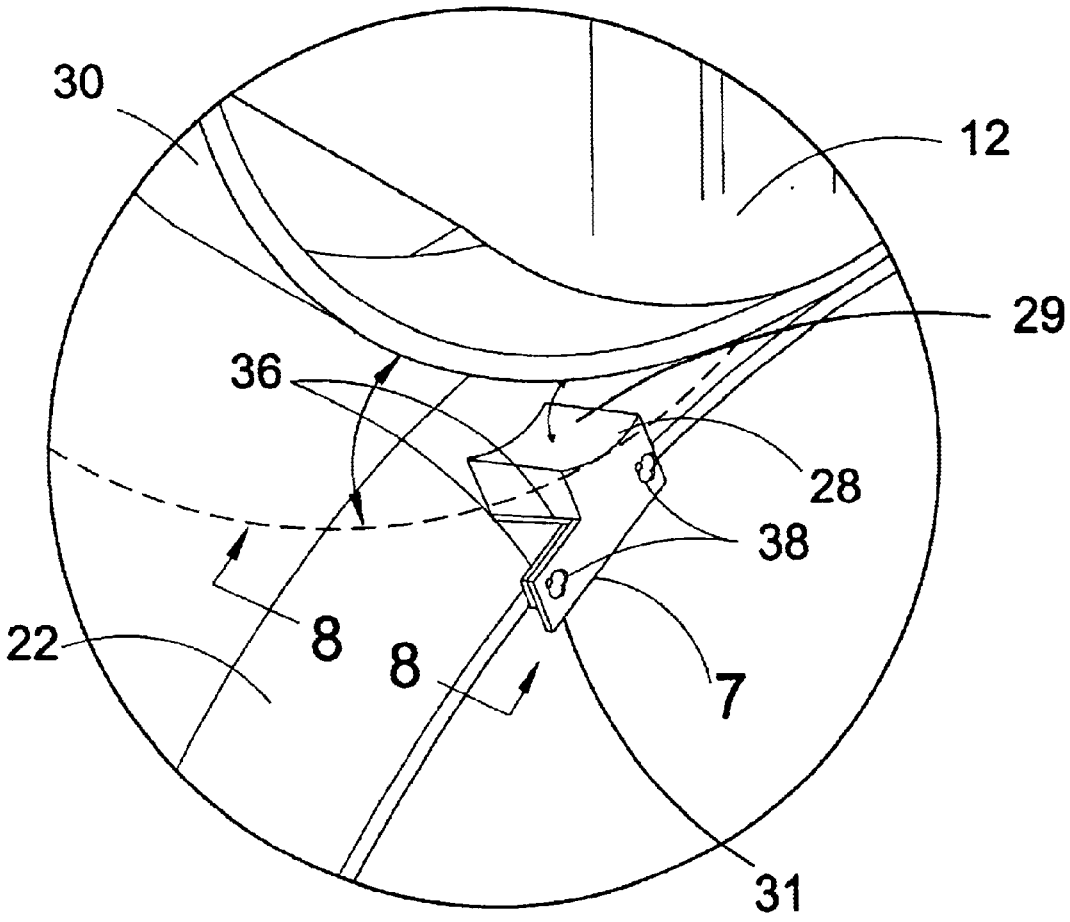
FIG. 6 is a detail view of the rocker limiter of the present invention.

Turning to FIG. 6, shown therein is a detail view of the rocker limiter 28 of the present invention. The rocker limiter 28 of the present invention is relocatably fixedly disposed between the rocker cam 30 and rocker base member 22 and may attach to the upper or lower rocker cam 30 and rocker base member 22 of a chair 12 by means of hook and loop fasteners 36 and/or fasteners, e.g., screws 38. The present invention serves to limit the forward rocking motion of a rocker chair 12. The rocker limiter 28 has an arcuate face 29 which is complementarily shaped as a rocker cam or rocker base member and a downwardly extending side 31 which provides a member with which to mount the rocker limiter 28.

Figure 7:
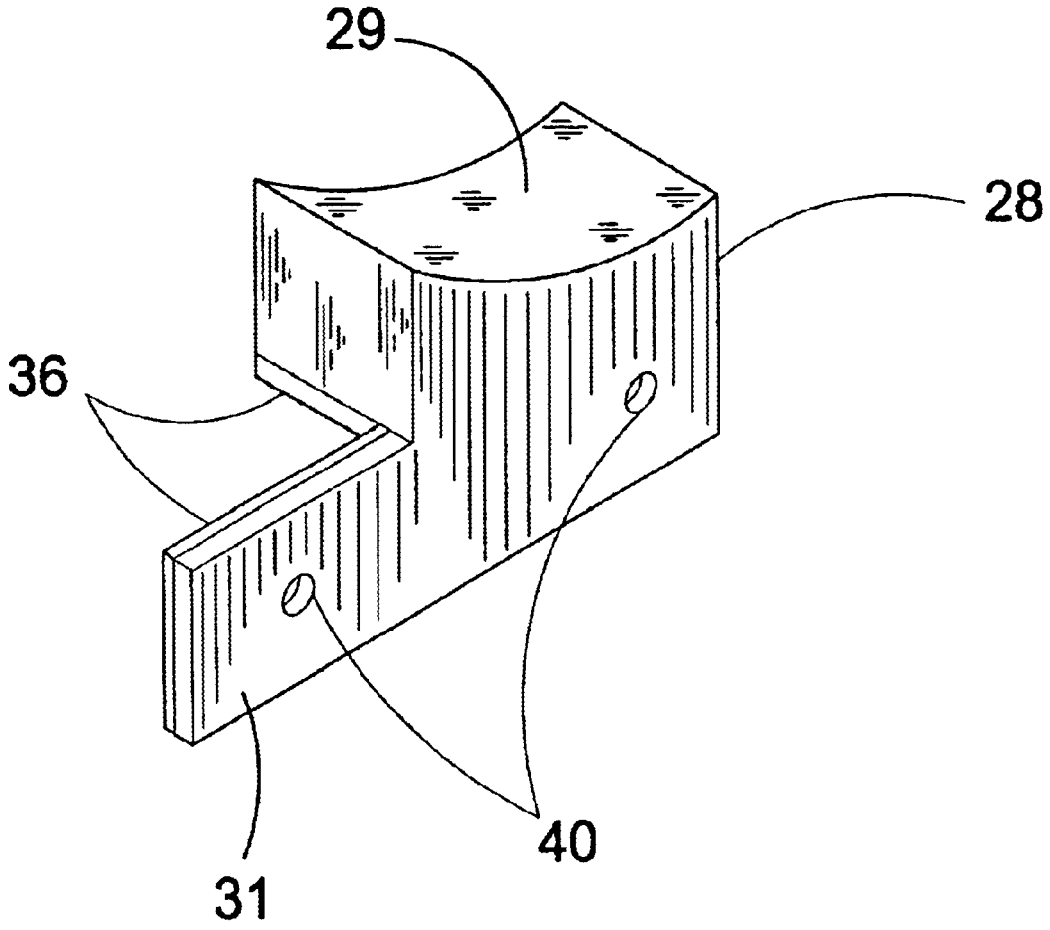
FIG. 7 is a detail view of the rocker limiter of the present invention.

Turning to FIG. 7, shown therein is a detail view of the rocker limiter 28 of the present invention. The rocker limiter 28 of the present invention can be fixedly positioned to the rocker cam or rocker base to limit the angular movement of the rocker mechanism in one direction by using hook and loop material 36 or other fasteners which extend through mounting holes 40 in the rocker limiter 28. The rocker limiter 28 has an arcuate face 29 which is complementarily shaped as a rocker cam 28 or rocker base member 22 and a downwardly extending side 31 which provides a member with which to mount the rocker limiter 28.

Figure 8:
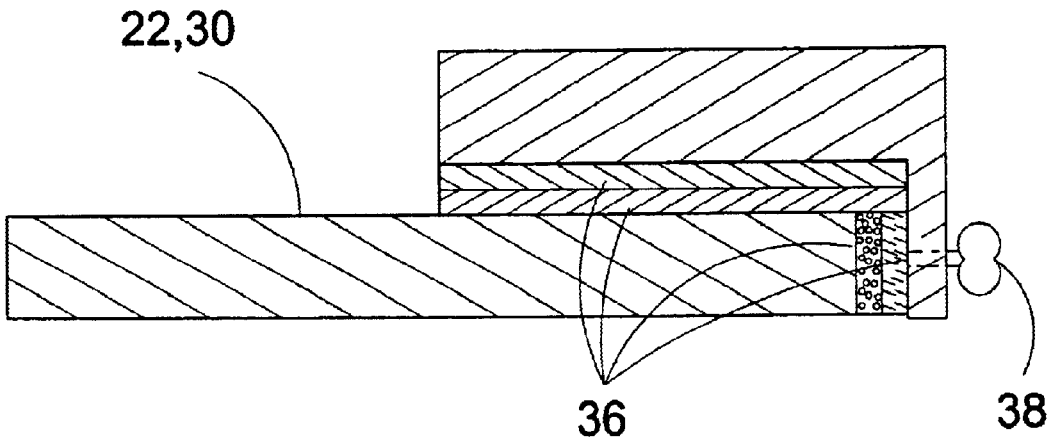
FIG. 8 is a sectional view of the rocker limiter of the present invention.

Turning to FIG. 8, shown therein is a sectional view of the rocker limiter 28 of the present invention. Shown is the rocker limiter 28 of the present invention having a plurality of applicable attachment means such as hook and loop material 36 or fasteners, e.g., screws 38 to provide a relocatable attachment should a progressive or selectable effective chair height be desired. An adhesive can also be used to provide a semi permanent attachment. The rocker cam 30 or rocker base member 22 are also shown.

Figure 9:
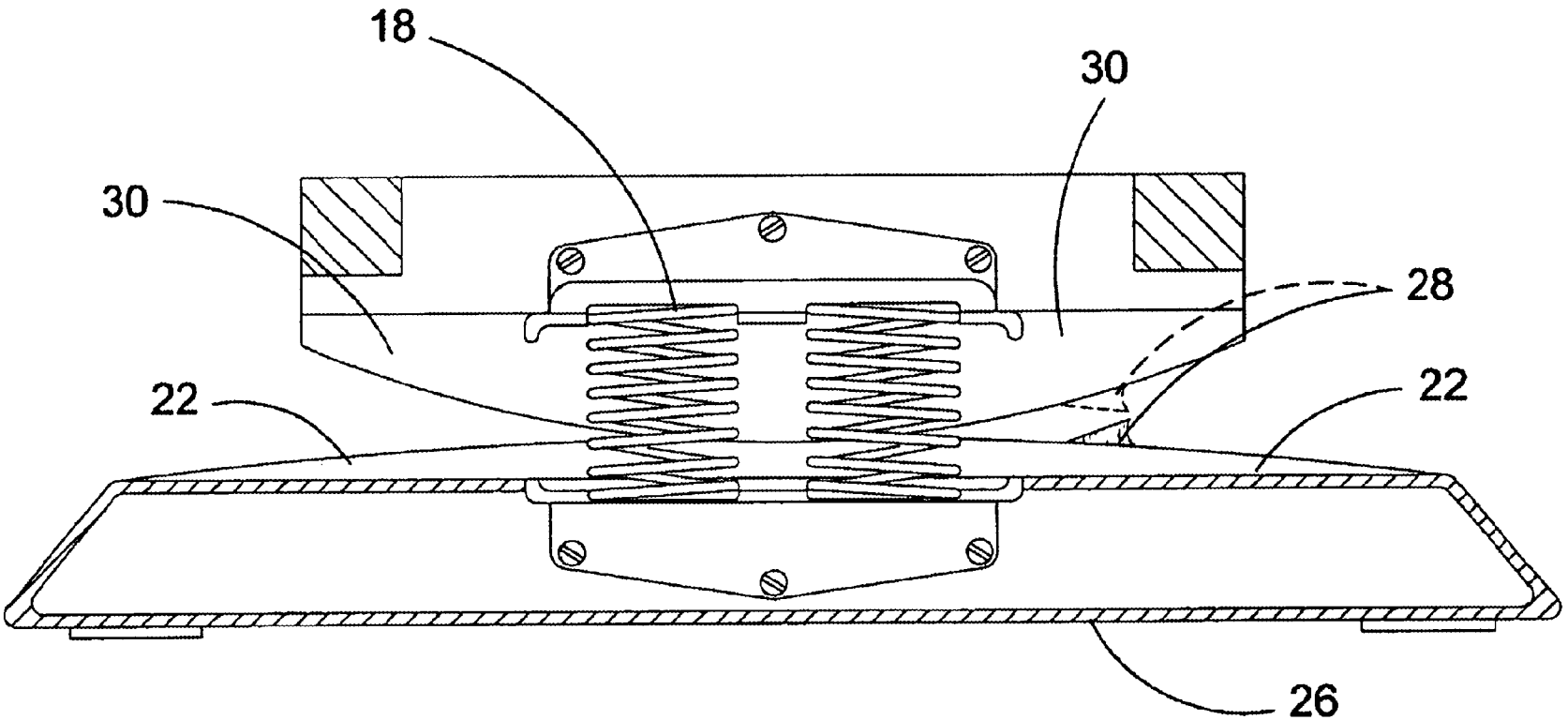
FIG. 9 is a cut away view of the rocker limiter installed.

Turning to FIG. 9, shown therein is a cut away view of the rocker limiter 28 installed. Shown is the rocker limiter 28 installed in a plurality of locations illustrating the rocker limiter's effectiveness in increasing the effective standing height. The effective chair height is dependent on the point of attachment of the rocker limiter 28 to the rocker cam 30 or rocker base member 22. This provides a user selectable effective chair height. The spring assembly 18 is also shown.

Figure 10:
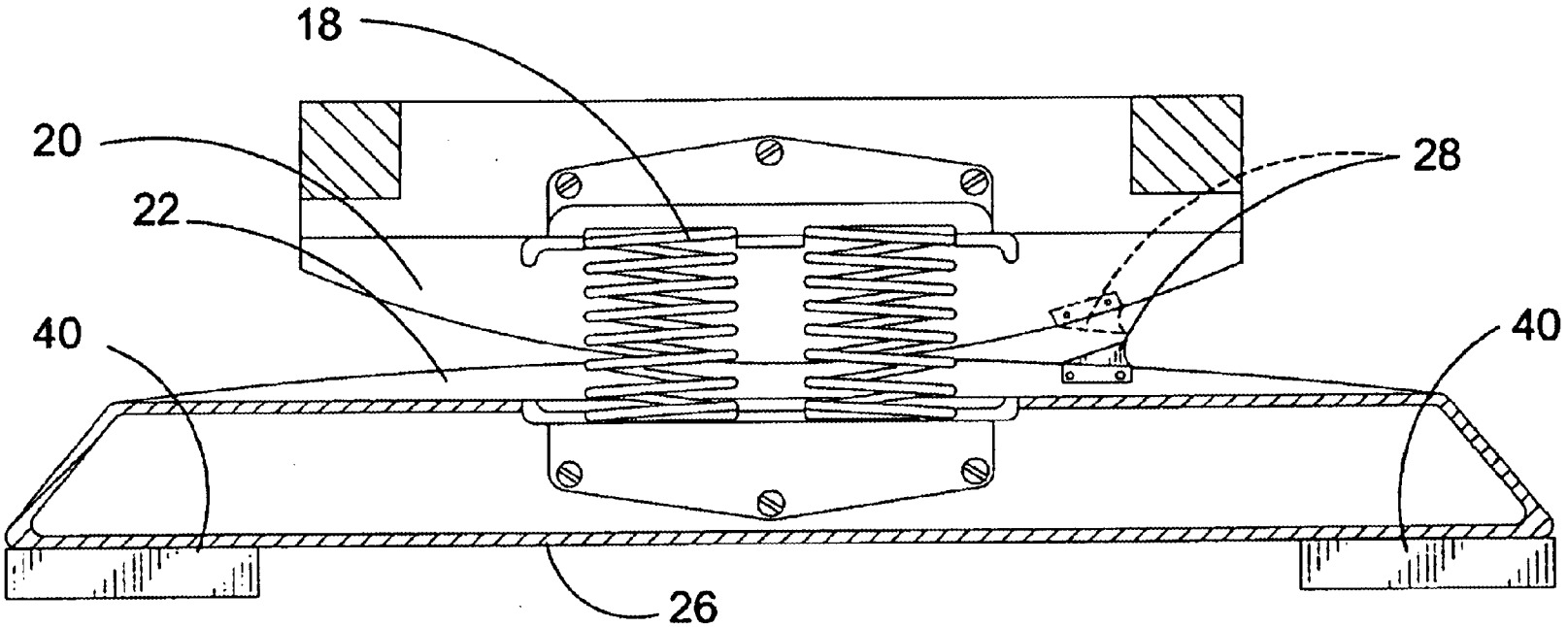
FIG. 10 is a partial view of a chair having chair base lifts.

Turning to FIG. 10, shown therein is a partial view of a chair having chair base lifts 40 installed thereon. Shown are the chair base lifts 40 on the bottom of the support base 26 used to raise the rocker recliner's height. The chair base lifts 40 can also be used in conjunction with the rocker limiter 28 to raise the effective chair height by a greater degree than the actual chair height. Also shown are the spring assembly 18, rocker base member 22 and rocker cam 20.

Figure 11:
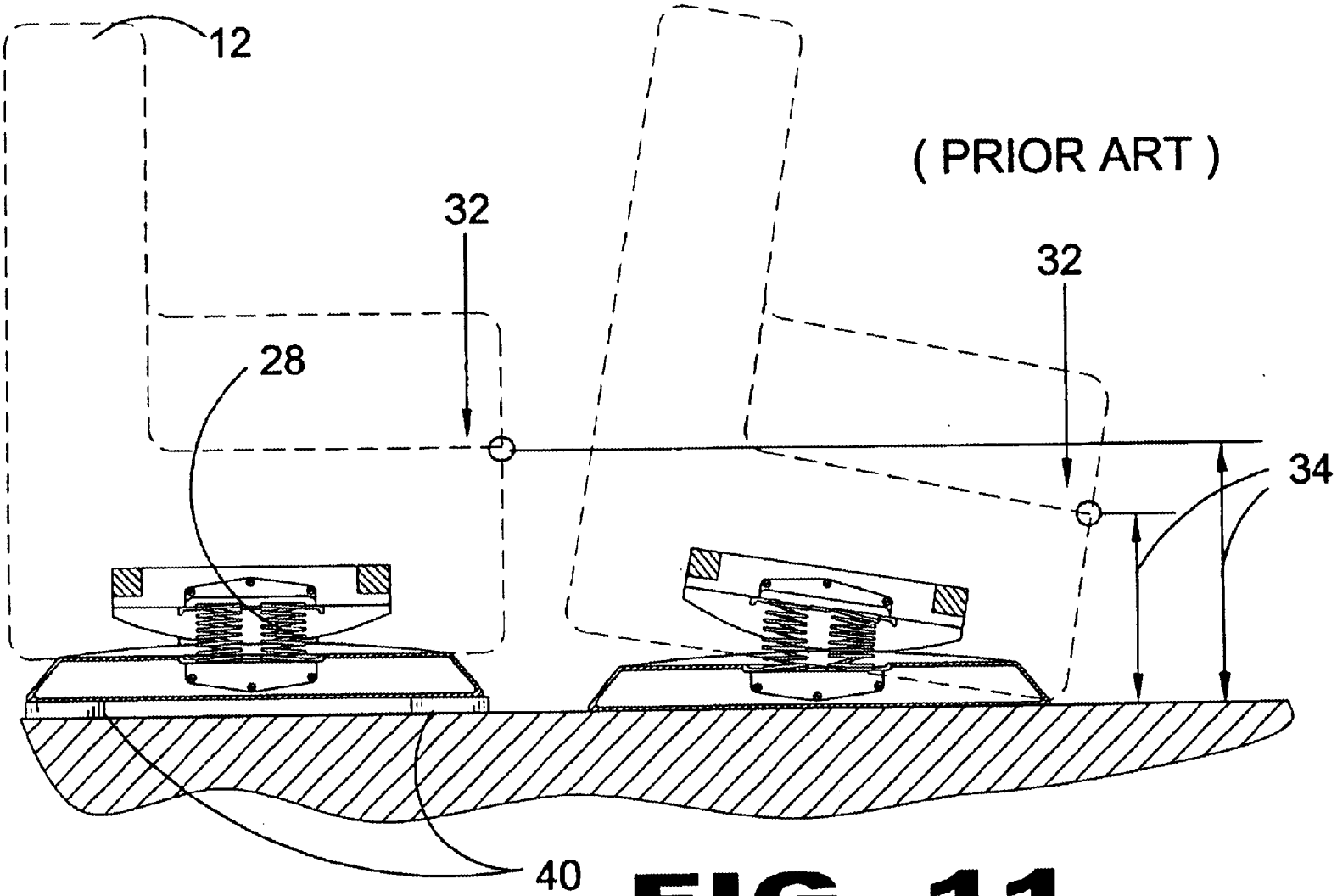
FIG. 11 is a side view of the present invention in operation.

Turning to FIG. 11, shown therein is a side view of the base lifts 40 installed as part of the present invention in operation. Shown are the chair base lifts 40 used in conjunction with the rocker limiter 28 to raise the effective chair height 34 an even greater degree, and to provide a system where both the rocker recliner's 12 total height and angular displacement can be adjusted according to the users needs. The system increases the effective chair height greater than the distance of the increase in actual chair height. Force 32 is also shown.

Figure 12:
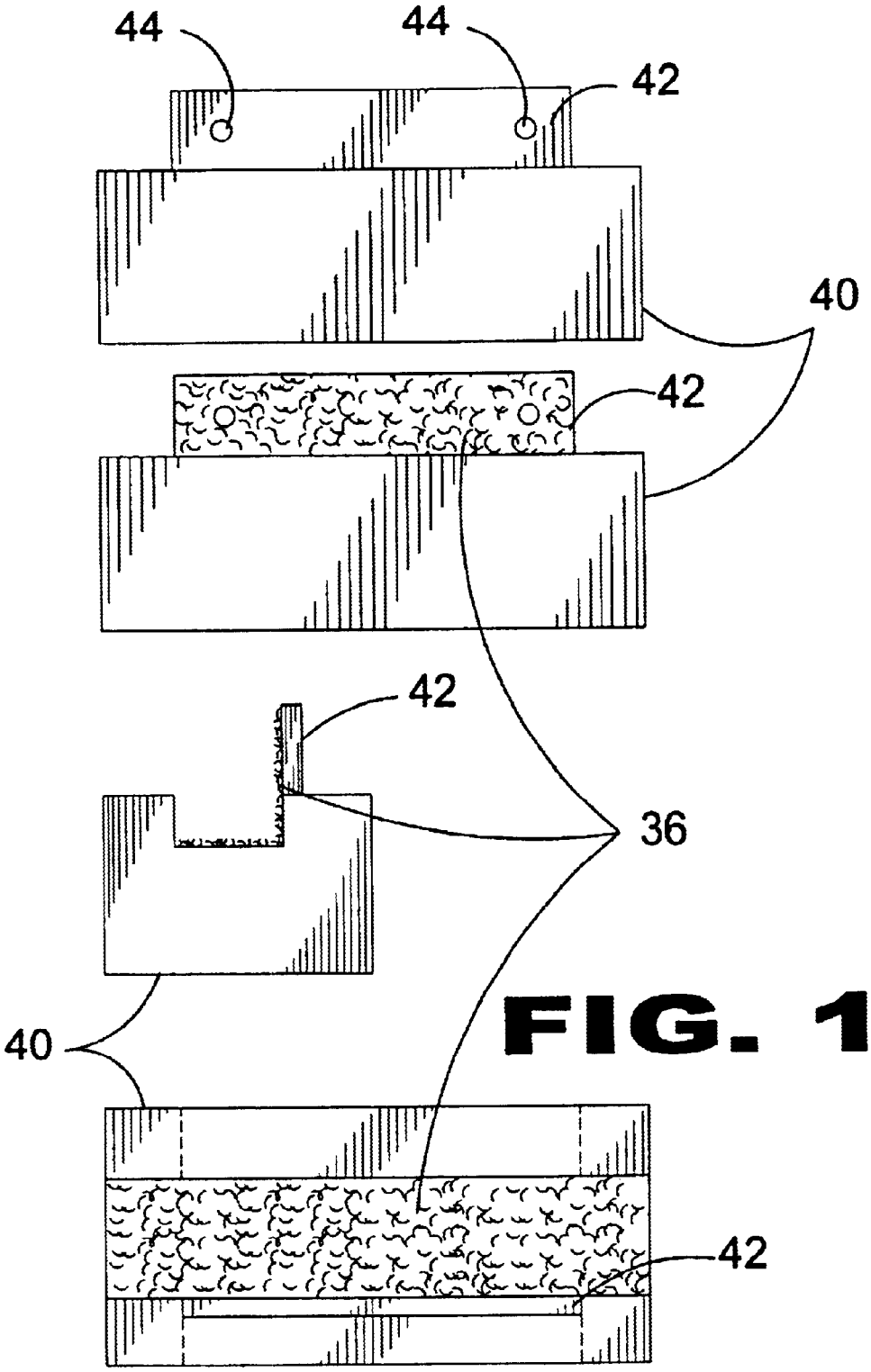
FIG. 12 is an orthographic view of the base lifts.

Turning to FIG. 12, shown therein is an orthographic view of the base lifts 40. Shown is a front, inside, side and top view of the present invention showing the base lifts 40 having a tab 42 disposed on one side thereof with throughbores 44 and hook and loop fasteners 36 attached thereto for the attachment of the base lifts 40 to a rocking chair's base.

Figure 13:
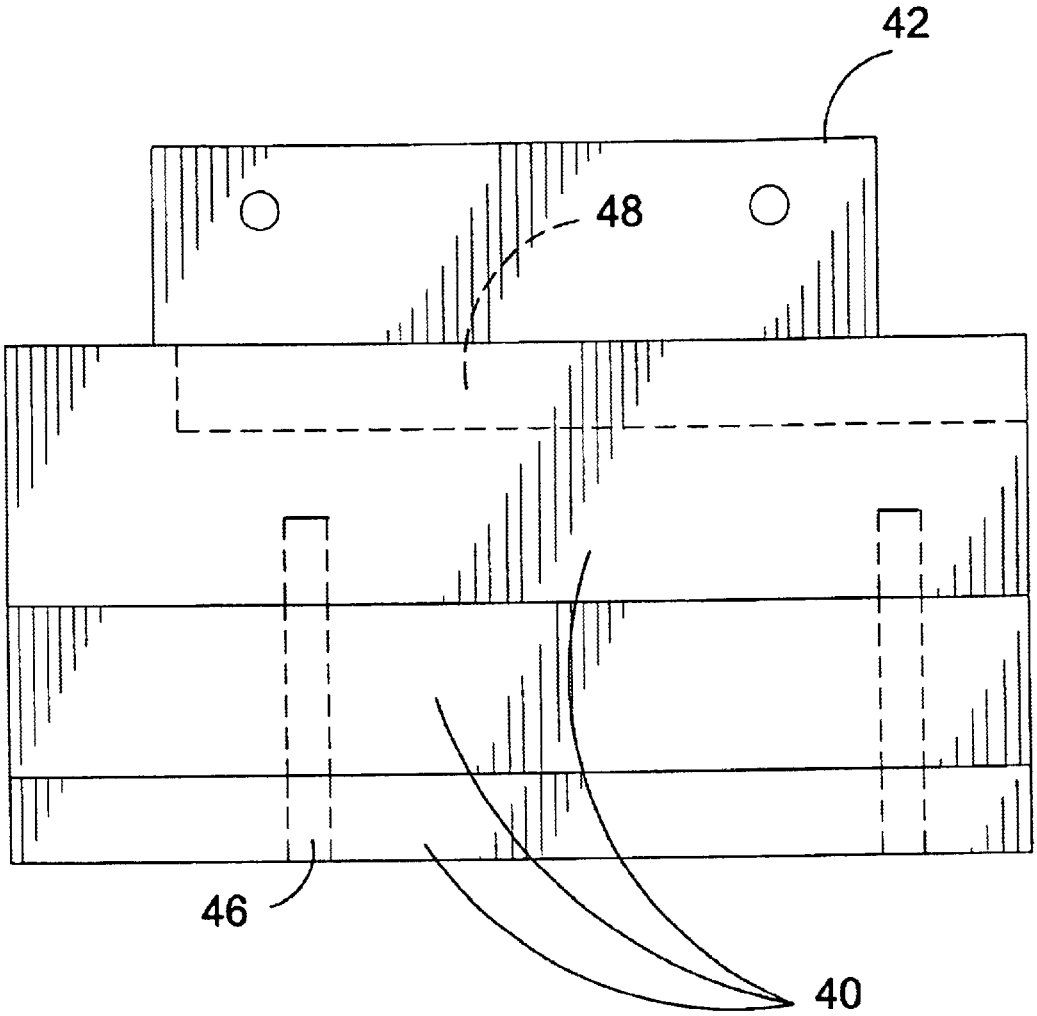
FIG. 13 is a side view of the chair base lifts.

Turning to FIG. 13, shown therein is a side view of the chair base lifts 40. Shown is a plurality of interlocking chair base lifts 40 that are engagingly positioned on top of one another having varying thicknesses to provide a system to raise a rocker recliner by a distance determined by the number and thickness of chair base lifts positioned thereunder. Also shown are the tab 42, screw holes 46 and a runner inset 48.

Figure 14:
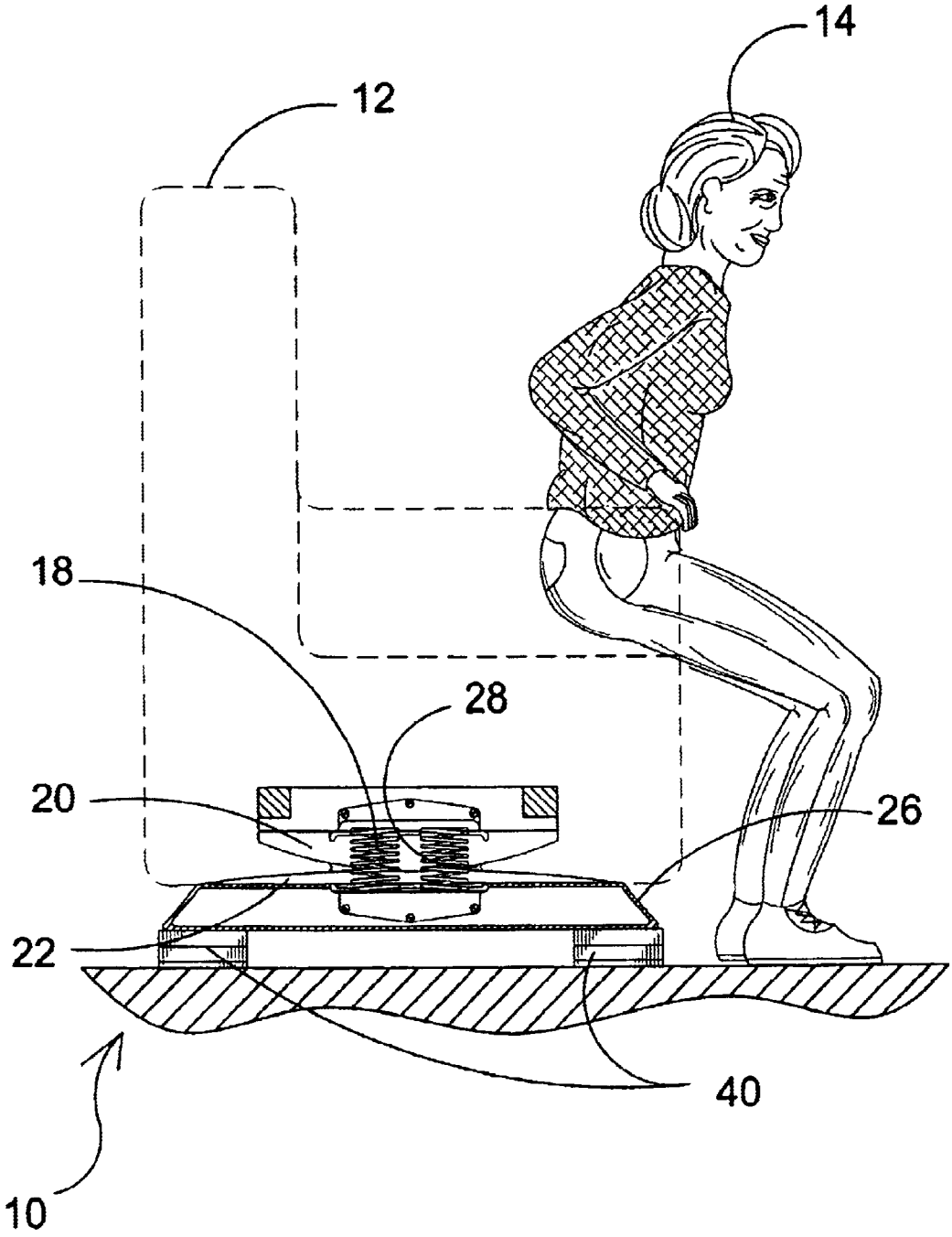
FIG. 14 is a side view of the present invention in use.

Turning to FIG. 14, shown therein is a side view of the present invention 10 in use. Shown is the present invention with both the rocker limiter 28 and a plurality of chair base lifts 40 installed on the rocker recliner 12 to significantly raise the rocker recliner's effective chair height to a comfortable level. Additionally this configuration can be used as a rehabilitation or exercise device by progressively adjusting the rocker limiter and/or by removing chair base lifts, to lower the effective chair height. Other elements previously disclosed are also shown.

Figure 15:
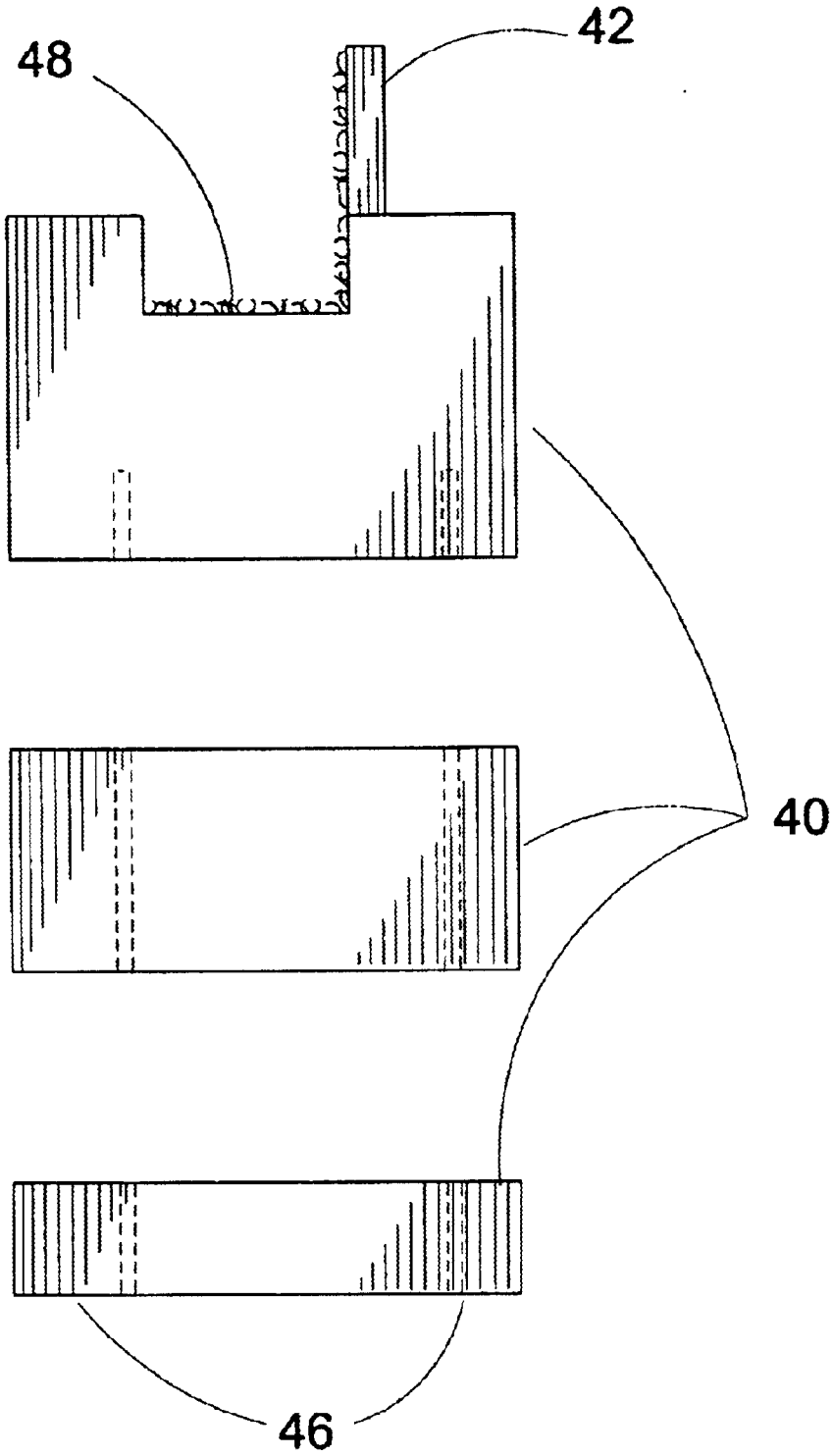
FIG. 15 is an end view of the plurality of chair lifts.

Turning to FIG. 15, shown therein is an end view of the chair base lifts 40. The chair base lifts have throughbores whereby fasteners can be inserted therethrough. Also shown are the screw holes 46, tab 42 and inset 48 for receiving an end of a support base for attachment thereto.

We claim:

1. An apparatus for a lift system for a conventional rocker recliner, the rocker recliner having a seating area, a pair of arms and a seat back, further the rocker recliner being supported underneath by a spring assembly and having an arcuate rocker cam and an arcuate rocker base member which cooperates with the rocker cam, and a support base, comprising:

a) a rocker limiter, said rocker limiter having an inner side and an outer side and an arcuate face joining said inner and outer sides to permit mating with either the rocker cam or the rocker base member;

b) the outer side of said rocker limiter being extended so that said outer side is L-shaped to extend along a curved edge of either the rocker cam or the rocker base member for attachment thereto, the extended outer side having a plurality of holes therein; and, c) means for relocatably, fixedly attaching said rocker limiter to either the rocker cam or the rocker base member whereby the face of the rocker limiter is disposed between the rocker cam and the rocker base member in order to vary the angular displacement between the rocker cam and the rocker base member.

2. The apparatus of claim 1, wherein said means for attaching said rocker limiter comprises mating hook and loop material to permit the rocker limiter to be attached to either the rocker cam or the rocker base member.

3. The apparatus of claim 1, wherein said means for attaching said rocker limiter comprises a plurality of fasteners extending through said holes in said extended side of said rocker limiter to permit the rocker limiter to be attached to either the rocker cam or the rocker base member.

4. The apparatus of claim 1, further comprising a rocker recliner support base lift whereby the height of the rocker recliner can be varied.

5. The apparatus of claim 4, wherein said rocker recliner support base lift comprises:

a) a base lift member being disposed underneath said support base so that said support base is elevated; and, b) means for attaching said base lift member underneath the support base.

6. The apparatus of claim 5, wherein said means for attaching said base lift member comprises mating hook and loop material.

7. The apparatus of claim 6, wherein said means for attaching said base lift member further comprises fasteners.

8. The apparatus of claim 7, wherein said base lift member further comprises a tab disposed on one side, said tab extending upwardly for engaging a side of said rocker support base, said tab having a plurality of holes therein, said holes for receiving fasteners to permit said base lift member to be attached with said fasteners to the rocker support base.

9. The apparatus of claim 8, wherein said base lift member has an inset therein, for receiving an end of the rocker support base to permit attachment thereto, an upper face of said base lift member being U-shaped with said tab extending up from one side of said inset.

10. The apparatus of claim 9, wherein said base lift member has a plurality of interlocking members so that the height of rocker recliner can be varied.

* * * * *